US006792913B1

(12) United States Patent
Oder

(10) Patent No.: US 6,792,913 B1
(45) Date of Patent: Sep. 21, 2004

(54) METHOD FOR OPERATING AN INTERNAL COMBUSTION ENGINE MAINLY INTENDED FOR A MOTOR VEHICLE

(75) Inventor: Michael Oder, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/424,606

(22) PCT Filed: Mar. 22, 1999

(86) PCT No.: PCT/DE99/00827

§ 371 (c)(1),
(2), (4) Date: Feb. 17, 2000

(87) PCT Pub. No.: WO99/49198

PCT Pub. Date: Sep. 30, 1999

(30) Foreign Application Priority Data

Mar. 26, 1998 (DE) ..... 198 13 379

(51) Int. Cl.[7] ..... F02B 17/00
(52) U.S. Cl. ..... 123/295; 123/305
(58) Field of Search ..... 123/295, 305

(56) References Cited

U.S. PATENT DOCUMENTS 5,078,107 A 1/1992 Morikawa
5,954,023 A * 9/1999 Mizuno et al. ..... 123/295
5,970,947 A * 10/1999 Iida et al. ..... 123/295
5,975,044 A * 11/1999 Kamura et al. ..... 123/295
5,975,045 A * 11/1999 Mizuno ..... 123/295
5,979,396 A * 11/1999 Yasuoka ..... 123/295
5,996,547 A * 12/1999 Machida et al. ..... 123/295
6,058,905 A * 5/2000 Nagaisha et al. ..... 123/295
6,058,906 A * 5/2000 Yoshino ..... 123/295
6,062,190 A * 5/2000 Nakajima ..... 123/295
6,085,717 A * 7/2000 Kamura et al. ..... 123/295

FOREIGN PATENT DOCUMENTS

EP 0 849 458 6/1998

OTHER PUBLICATIONS

Patent Abstracts of Japan, vol. 017, No. 233 (M–1407), May 12, 1993 & JP 04 362221 A (Toyota Motor Corp.) Dec. 15, 1992.
Patent Abstracts of Japan, vol. 097, No. 010, Oct. 31, 1997 & JP 09 151771 A (Nissan Motor Co. Ltd.) Jun. 10, 1997.

* cited by examiner

*Primary Examiner*—Erick Solis
(74) *Attorney, Agent, or Firm*—Kenyon & Kenyon

(57) ABSTRACT

An internal combustion engine (1), in particular for a motor vehicle, is described, that is provided with an injection valve (8), using which fuel can be directly injected into a combustion chamber (4) either in a first mode during an intake phase or in a second mode during a compression phase. In addition, a control unit (16) is provided for the control and/or feedback control of the fuel quantity injected into the combustion chamber (4), the control and/or feedback control being different in the two modes. The switchover from the first mode initially (26) to a transitional operation of the second mode and then (31, 37) to a normal operation of the second mode is effected by the control unit (16).

28 Claims, 3 Drawing Sheets

METHOD FOR OPERATING AN INTERNAL COMBUSTION ENGINE MAINLY INTENDED FOR A MOTOR VEHICLE

FIELD OF THE INVENTION

The present invention relates to a method for operating an internal combustion engine, in particular a motor vehicle, in which fuel is injected directly into a combustion chamber either in a first mode during a compression phase or in a second mode during an intake phase, and in which the fuel quantity injected into the combustion chamber is subjected to control and/or feedback control in differing ways in the two modes. In addition, the present invention relates to an internal combustion engine, in particular a motor vehicle, having an injection valve, using which fuel can be injected directly into a combustion chamber either in a first mode during an intake phase or in a second mode during a compression phase, and having a control unit for the differing control and/or feedback control of the fuel quantity injected into the combustion chamber in the two modes.

BACKGROUND INFORMATION

Conventional systems directly inject fuel into the combustion chamber of an internal combustion engine. In this context, the distinction is made between so-called stratified operation, as the first mode, and so-called homogeneous operation, as the second mode. Stratified operation is used, in particular, in the case of smaller loads, whereas homogeneous operation is used in the case of larger loads placed on the internal combustion engine.

In stratified operation, the fuel during the compression phase of the internal combustion engine is injected into the combustion chamber such that at the moment of ignition, a fuel cloud is located in the immediate vicinity of a spark plug. This injection can take place in different ways. Thus, it is possible that the injected fuel cloud is located at the spark plug during or directly after the injection and is ignited by the spark plug. Likewise, it is possible that the injected fuel cloud is directed to the spark plug by a movement of the charge and is only then ignited. In both combustion methods, there is no even distribution of the fuel but rather a stratified charge.

The advantage of the stratified operation lies in the fact that using a very small quantity of fuel the smaller loads applied can be handled by the internal combustion engine. Larger loads, on the other hand, can not be handled by the stratified operation.

In homogeneous operation, which is provided for larger loads of this type, the fuel is injected during the intake phase of the internal combustion engine so that a swirl effect and thus a distribution of the fuel in the combustion chamber can take place without difficulty. To this extent, the homogeneous operation roughly corresponds to the mode of internal combustion engines in which fuel is injected into the intake pipe in the conventional manner. If necessary, homogeneous operation can also be employed with smaller loads.

In stratified operation, the throttle valve in the intake pipe leading to the combustion chamber is opened wide and the combustion is controlled and/or feedback controlled only by the fuel quantity to be injected. In homogeneous operation, the throttle valve is opened or closed as a function of the torque requested and the fuel quantity to be injected is controlled and/or feedback controlled as a function of the quantity of air taken in.

In both modes, i.e., in stratified operation and in homogeneous operation, the fuel quantity to be injected is controlled and/or feedback controlled as a function, additionally, of a plurality of further input variables with respect to an optimal value regarding fuel economy, emissions reduction, and the like. The control and/or feedback control, in this context, is different in the two modes.

It is necessary to switch the internal combustion engine from stratified operation to homogeneous operation and back again. In stratified operation, the throttle valve is opened wide and the air is therefore supplied in a largely unthrottled (unimpeded) manner. In the homogeneous operation, the throttle valve is only partially opened thus limiting the supply of air. Above all, in the switchover from stratified to homogeneous operation, the capacity to accumulate air in the intake pipe leading to the combustion chamber must be taken into account. If this is not taken into account, the switchover can lead to an increase in the torque generated by the internal combustion engine.

A Summary objective of the present invention is to provide a method for operating an internal combustion engine using which an optimal switchover is possible between the two modes. This object is achieved according to the present invention in that a switchover takes place from the first mode initially to transitional operation of the second mode and then to normal operation of the second mode.

Thus the switchover does not occur immediately to homogeneous operation, i.e., to a stoichiometric or rich air/fuel mixture, but rather the internal combustion engine is first operated in a transitional operation of the homogeneous operation. As a result of this transitional operation, it is achieved that the entire switchover procedure from stratified operation to homogeneous operation leads to a significantly lower increase of the torque generated by the internal combustion engine. Therefore, there is a significantly smaller excess torque that has to be eliminated for example by a retarded (late) setting of the ignition angle. This not only represents marked fuel economy, but also, as a result of the reduced retarded setting of the ignition angle, the possibility of changes in the torque generated by the internal combustion engine is significantly reduced. Therefore, disruptions have only diminished influence on the smooth running of the internal combustion engine. Furthermore, as a result of the reduced retarded setting of the ignition angle, a reduced increase in the emission temperature is achieved, which is also advantageous for the smooth running of the internal combustion engine and for its service life.

In an example embodiments of the present invention, the air quantity supplied is measured, and a switchover occurs from the first mode to the transitional operation of the second mode as a function of the air quantity supplied, specifically after the air quantity supplied sinks below a first threshold value, or a switchover occurs from the transitional operation of the second mode to the normal operation of the second mode as a function of the air quantity supplied, specifically after the air quantity supplied sinks below a second threshold value.

The switchover procedures are therefore carried out as a function of the air quantity supplied. The air quantity supplied can, be measured, for example, with the assistance of a mass airflow sensor. Then, if necessary as a function of the rotational speed of the internal combustion engine and/or other parameters, the two threshold values for the switchover procedures are determined. If the air quantity accumulating in the intake pipe is reduced, then the level initially sinks below the first threshold value. Thereupon, the internal combustion engine is switched over from stratified operation to the transitional operation of homogeneous operation. The air quantity accumulating in the intake pipe is reduced further and then sinks below the second threshold value. The internal combustion engine is then switched over from the transitional operation to the normal operation of homogeneous operation. The dependence of the switchover procedures on the air quantity supplied represents, in this context, a particularly simple and precise way of carrying out the entire switchover of the internal combustion engine from stratified operation to homogeneous operation.

In an advantageous embodiment of the present invention, in the transitional operation of the second mode, the fuel/air mixture supplied is controlled and/or feedback controlled in accordance with a somewhat leaner value. The transitional operation of the homogeneous operation is therefore a leaner homogeneous operation or a homogeneous leaner operation having a leaner air/fuel ratio. The fuel/air mixture therefore has a value greater than 1.

In this context, it is particularly advantageous if, after the switchover from the first mode to the transitional operation of the second mode, the fuel quantity to be injected is determined on the basis of the air quantity supplied and the torque requested. This represents a simple and precise way of realizing the leaner homogeneous operation.

Furthermore, it is particularly advantageous if, after the switchover from the first mode to the transitional operation of the second mode, the ignition angle is determined on the basis of the air quantity supplied, the fuel quantity injected, and the torque requested. Thus the requested torque can be generated simply and precisely during leaner homogeneous operation.

In a further advantageous embodiment of the present invention, in the normal operation of the second mode, the fuel/air mixture supplied is controlled and/or feedback controlled in accordance with a preselected, in particular stoichiometric value. The fuel/air mixture therefore has a defined, preselected value, for example 1. In this way, a particularly low-emission operation of the internal combustion engine is achieved.

In this context, it is particularly advantageous if, after the switchover from the transitional operation to the normal operation of the second mode, the fuel quantity to be injected is determined on the basis of the air quantity supplied. In this manner, it can be assured that the preselected or stoichiometric value of the fuel/air mixture is maintained.

Furthermore, it is may be advantages; if, after the switchover from the transitional operation to the normal operation of the second mode, the ignition angle is determined on the basis of the torque requested. Using the ignition angle, particularly short-lasting changes in the torque can be achieved in this way, without having to change the preselected or stoichiometric value.

The method according to the present invention may be realized in the form of a control element, which is provided for a control unit of an internal combustion engine, in particular a motor vehicle. In this context, a program is stored in the control element that is executable in a computing device, in particular in a microprocessor, and that is suitable for carrying out the method of the present invention. In this case, the present invention will be thus realized by a program that is stored on the control element so that this control element, which is provided with the program, represents the present invention in the same manner as the method for whose implementation the program is suited. As the control element, specifically an electrical storage medium can be used, for example a read-only memory.

Further features, application possibilities, and advantages of the present invention can be seen from the following description of the exemplary embodiments of the invention, represented in the Figures of the drawing. In this context, all of the features described or depicted, either singly or in any combination, constitute the subject matter of the present invention, irrespective their antecedent reference, and irrespective of their formulation or representation in the description or in the drawing.

DETAILED DESCRIPTION

Figure 1:
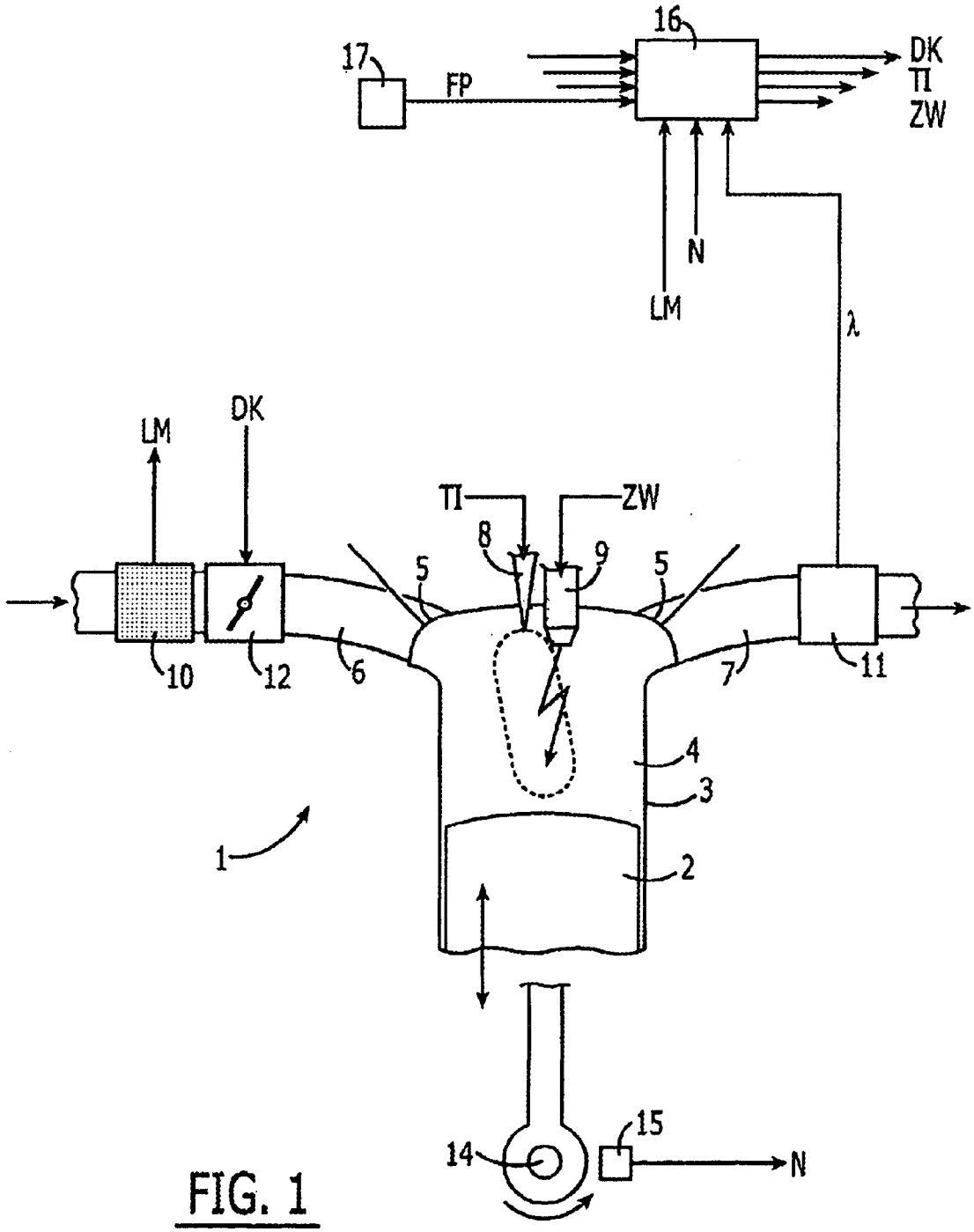
FIG. 1 shows a schematic block diagram of an exemplary embodiment of an internal combustion engine of a motor vehicle according to the present invention.

In FIG. 1, an internal combustion engine 1 is depicted in which a piston 2 can move back and forth in a cylinder 3. Cylinder 3 is provided with a combustion chamber 4, to which an intake pipe 6 and an exhaust pipe 7 are connected via valves 5. In addition, combustion chamber 4 has assigned to it an injection valve 8 that can be driven by a signal TI and a spark plug that can be driven by a signal ZW.

Intake pipe 6 is provided with an airflow sensor 10, and exhaust pipe 7 can be provided with a lambda (oxygen) sensor 11. Airflow sensor 10 measures the air quantity of the fresh air supplied to intake pipe 6 and generates, in accordance therewith, a signal LM. A lambda sensor 11 measures the oxygen content of the exhaust gases in exhaust pipe 7 and, in accordance therewith, generates a signal $\lambda$.

In intake pipe 6, a throttle valve 12 is accommodated whose rotational position can be adjusted in accordance with a signal DK.

In a first mode, the stratified operation of internal combustion engine 1, throttle valve 12 is opened wide. The fuel is injected by injection valve 8 into combustion chamber 4 during a compression phase that is generated by piston 2, specifically, in spatial terms, in the immediate vicinity of spark plug 9, as well as, in temporal terms, at a suitable interval before the moment of ignition. Then, with the assistance of spark plug 9, the fuel is ignited so that piston 2, in the working phase that now ensues, is driven by the expansion of the ignited fuel.

In a second mode, the homogeneous operation of internal combustion engine 1, throttle valve 12 is partially opened or closed as a function of the desired air quantity supplied. The fuel is injected by injection valve 8 into combustion chamber 4 during an intake phase that is generated by piston 2. The injected fuel is swirled by the air that is taken in at the same time and is thus evenly distributed in combustion chamber 4. Subsequently, the fuel/air mixture is compressed during the compression phase in order then to be ignited by spark plug 9. Piston 2 is driven by the expansion of the ignited fuel.

In stratified operation, as well as in homogeneous operation, a crankshaft 14 is set into rotational motion, ultimately driving the wheels of the motor vehicle. Crankshaft 14 has assigned to it a rotational speed sensor 15, which generates a signal N as a function of the rotational motion of crankshaft 14.

Both in stratified operation and in homogeneous operation, the fuel quantity injected into combustion chamber 4 by injection valve 8 is controlled and/or feedback controlled by a control unit 16, in particular with a view towards low fuel consumption and/or low emission production. For this purpose, provision is made for control unit 16 having a microprocessor, which, in a storage medium, in particular in a read-only memory, has a program stored in it that is suitable for executing the aforementioned control and/or feedback control.

Control unit 16 is acted upon by input signals which represent the internal combustion engine's operating variables, which are measured by sensors. For example, control unit 16 is connected to airflow sensor 10, lambda sensor 11, and rotational speed sensor 15. In addition, control unit 16 is connected to accelerator sensor 17, which generates a signal FP indicating the position of an accelerator that can be actuated by a driver. Control unit 16 generates output signals on the basis of which, via actuators, the performance of the internal combustion engine can be influenced in accordance with the desired control and/or feedback control. For example, control unit 16 is connected to injection valve 8, spark plug 9, and throttle valve 12, and generates signals TI, ZW, and DK, that are necessary to drive them.

The method described below in connection with of FIGS. 2 and 3 for the switchover from stratified to homogeneous operation is executed by control unit 16. The blocks indicated in FIG. 2, in this context, represent functions of the method that are realized in control unit 16, for example, in the form of software modules or the like.

Figure 2:
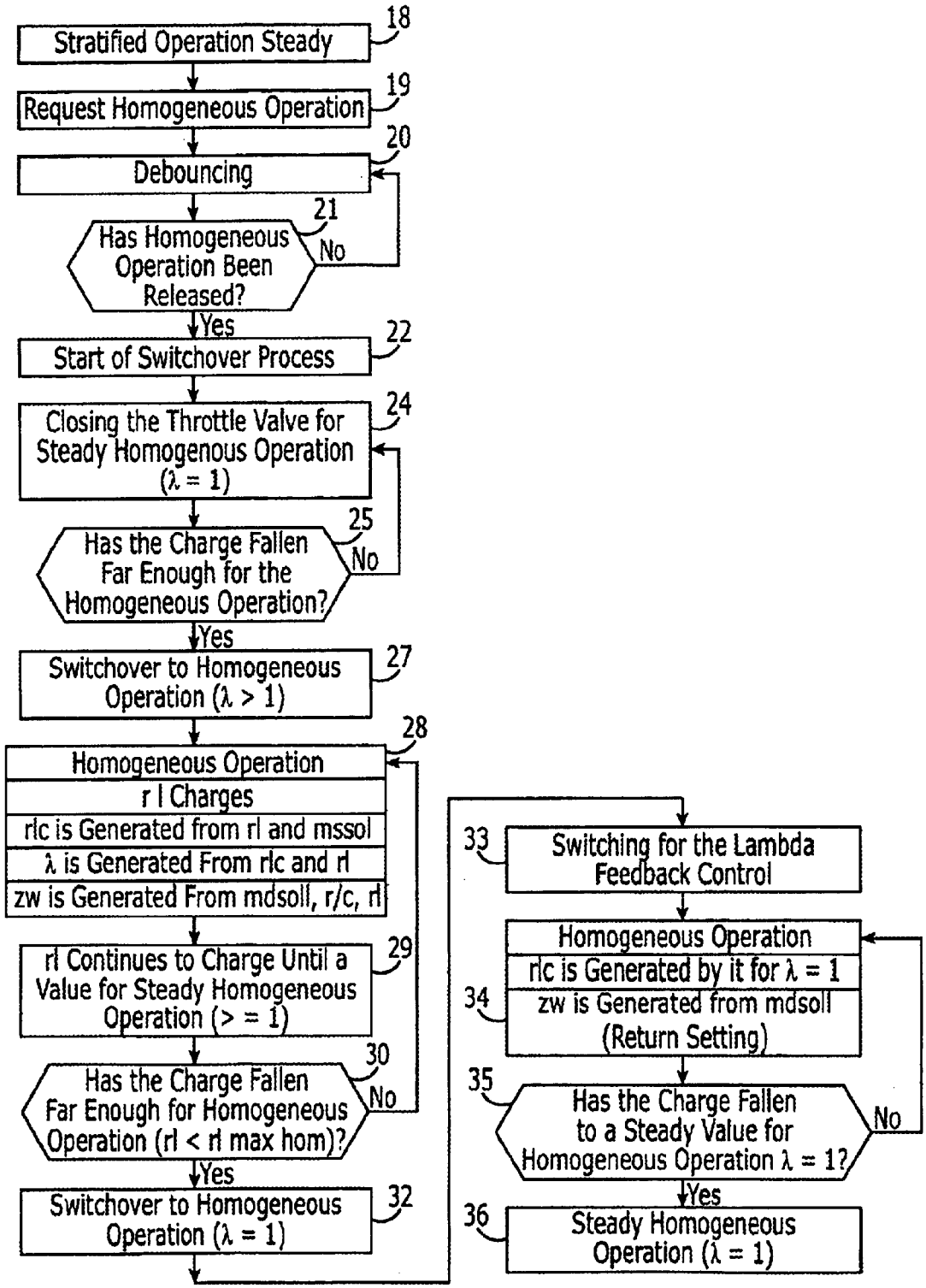
FIG. 2 shows a schematic flow chart of an exemplary embodiment of the method according to the present invention for operating the internal combustion engine of FIG. 1.
Figure 3:
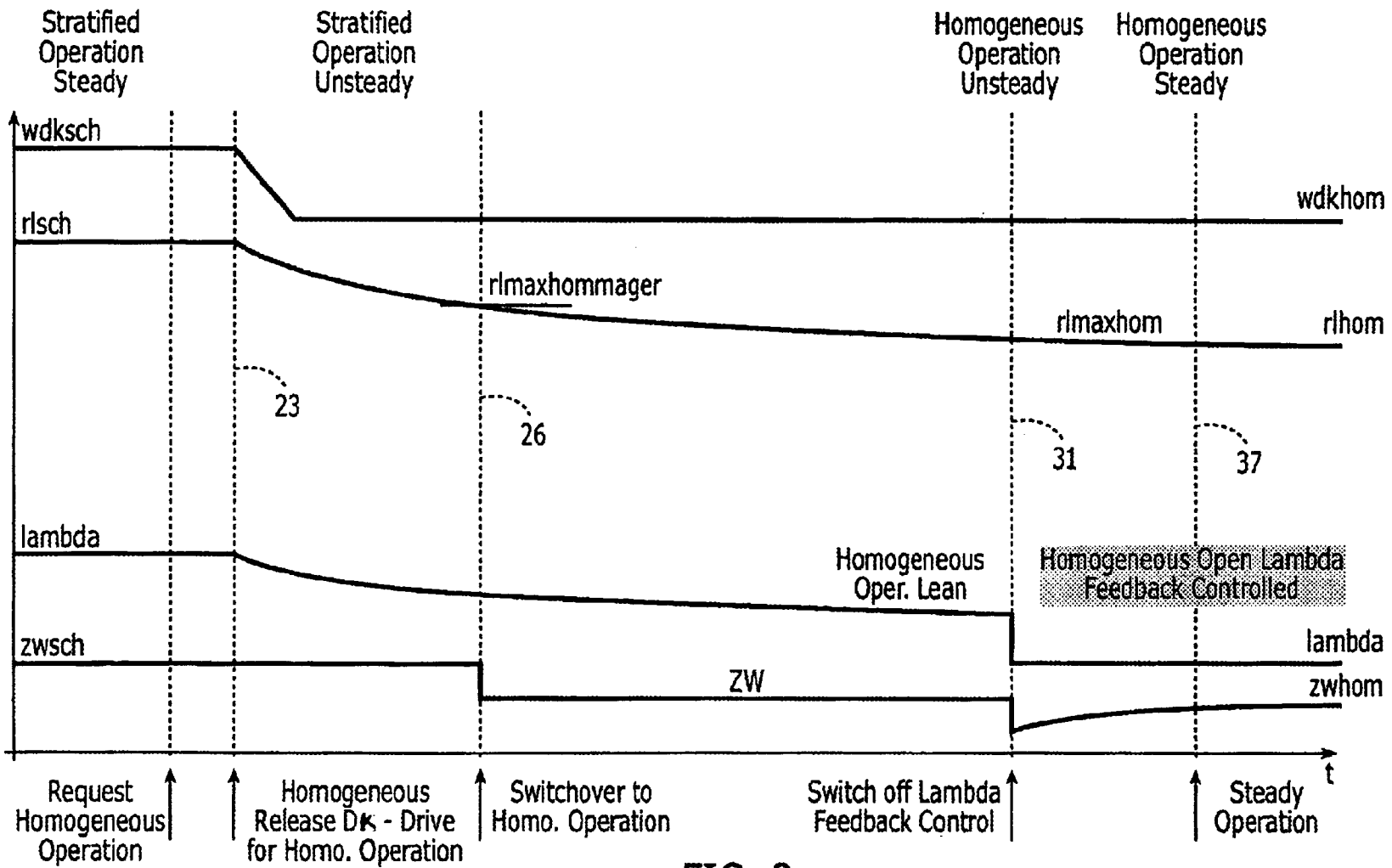
FIG. 3 shows a schematic time diagram of signals of the internal combustion engine of FIG. 1 during the execution of the method according to FIG. 2.

In FIG. 2, in a block 18, it is assumed that internal combustion engine 1 is in a steady stratified operation. In a block 19, for example, in the event of an acceleration of the motor vehicle desired by the driver, the transition is requested to homogeneous operation. The moment of the request for homogeneous operation is also visible in FIG. 3.

Subsequently, on the basis of blocks 20, 21, a debouncing occurs by which a rapid switching back and forth between stratified and homogeneous operation is prevented. If the homogeneous operation is released, then the transition from stratified operation to homogeneous operation is initiated by a block 22. The moment at which the switchover procedure begins is designated in FIG. 3 by reference numeral 23.

At aforementioned moment 23, throttle valve 12 is controlled so as to shift from its condition in stratified operation of being completely opened wdksch to an at least partially opened or closed condition wdkhom for homogeneous operation. The rotational position of the throttle valve in the homogeneous operation, in this context, is set at a stoichiometric fuel/air mixture, i.e., at $\lambda=1$, and is also a function of, e.g., the requested torque and/or rotational speed N of the internal combustion engine 1, etc.

By adjusting throttle valve 12, internal combustion engine 1 moves from the steady (fixed) stratified operation to an unsteady stratified operation. In this operating state, the air quantity supplied to combustion chamber 4 slowly decreases from a charge rlsch during the stratified operation to smaller charges. This can also be seen from FIG. 3. Air quantity rl supplied to combustion chamber 4 or its charge are determined, in this context, by control unit 16, inter alia, on the basis of signal LM of airflow sensor 10.

In a block 25 of FIG. 2, a check test is conducted as to whether the air quantity supplied to combustion chamber 4 has achieved a given value, specifically whether charge rl has become smaller than a maximum charge for a homogeneous lean operation rlmaxhommager. Thus a check test is run as to whether rl<rlmaxhommager. Charge rlmaxhommager is, in this context, selected such that the torque generated by internal combustion engine 1 remains roughly constant.

If rl<rlmaxhommager is not satisfied, then in a loop via block 24, the waiting continues. However, if this is the case (i.e., if rl<rlmaxhommager is satisfied), which is indicated in FIG. 3 in a moment designated with a reference numeral 26, then at this moment the switchover occurs from the unsteady stratified operation to an unsteady homogeneous operation. In accordance with FIG. 2, in this context, the switchover is executed by a block 27.

The unsteady homogeneous operation is distinguished from a steady homogeneous operation by the fact that the fuel/air mixture is lean, $\lambda$ is therefore larger than 1, and the operational variables of internal combustion engine 1, e.g., the charge of combustion chamber 4, continue to change. Thus there is a lean homogeneous operation or a homogeneous lean operation of internal combustion engine 1. This lean homogeneous operation represents a transitional mode to the normal mode of the homogeneous operation.

In the lean homogeneous operation, internal combustion engine 1 in accordance with block 28 of FIG. 2, is controlled or feedback controlled such that fuel quantity rk is determined on the basis of requested torque mdsoll and of air quantity rl supplied to combustion chamber 4. Fuel/air mixture $\lambda$ is determined on the basis of air quantity rl and fuel quantity rk injected into combustion chamber 4. Ignition angle ZW for spark plug 9 of internal combustion engine 1 is determined and set as a function of requested torque mdsoll, air quantity rl, and fuel quantity rk.

In the lean homogeneous operation, air quantity rl supplied to combustion chamber 4 decreases further to smaller charges. This is represented in FIG. 2 by a block 29. In a block 30, a check test is conducted as to whether the air quantity supplied to combustion chamber 4 has reached a predetermined value, specifically whether charge rl has become smaller than a maximum charge for normal homogeneous operation rlmaxhom. Thus a check test is conducted as to whether rl<rlmaxhom. Charge rlmaxhom, in this context, is specified such that in the normal homogeneous operation a stoichiometric fuel/air at mixture, i.e., $\lambda=1$, is present. In addition, this charge is specified such that generated torque Md remains constant.

If rl<rlmaxhom is not satisfied, then in a loop via blocks 28, 29, the waiting continues. However, if this is the case (i.e., if rl<rlmaxhom is satisfied), which in FIG. 3 is indicated in a moment designated by reference numeral 31, then at this moment the switchover occurs from the unsteady lean homogeneous operation to a homogeneous operation. In accordance with FIG. 2, the switchover is executed, in this context, by block 32.

At moment 31, the lambda feedback control is switched on so that the homogeneous operation having a preselected $\lambda$ value is continued, for example $\lambda=1$, i.e., a stoichiometric fuel/air mixture. This is depicted in FIG. 2 in a block 33. The lambda feedback control controls and/or feedback controls fuel quantity rk injected into combustion chamber 4 such that, e.g., a stoichiometric fuel/air mixture arises, i.e., $\lambda=1$.

Fuel quantity rk, influenced in this manner, results in the fact that—at least during a certain time interval—torque Md generated by internal combustion engine 1 would rise. This is compensated for by the fact that at moment 31, i.e., upon the switching on of the lambda feedback control, ignition angle ZW is positioned such that generated torque Md remains roughly constant.

This is achieved in FIG. 2 by a block 34. There, fuel quantity rk is determined on the basis of air quantity rl supplied to combustion chamber 4 on the assumption of a stoichiometric fuel/air mixture. In addition, ignition angle ZW is adjusted in the direction of a retarded ignition as a function of torque mdsoll to be generated. With respect to this retarded setting, there thus still exists a certain deviation from the normal homogeneous operation, on the basis of which the air quantity, which is still too great, and the resulting torque generated, which is too great, of internal combustion engine 1 are temporarily nullified.

In a block 35, a check test is run as to whether air quantity rl supplied to combustion chamber 4 has finally fallen to the charge which is associated with a steady homogeneous operation at a stoichiometric fuel/air mixture. If this is not yet the case, then in a loop via block 34, the waiting continues. However, if this is the case, then internal combustion engine 1 in the steady homogeneous operation continues in operation using block 36 without an ignition angle adjustment. In FIG. 3 this is the case at a moment designated by reference numeral 37.

In this steady homogeneous operation, the air quantity supplied to combustion chamber 4 corresponds to charge rlhom for the homogeneous operation, and the ignition angle zwhom for spark plug 9 likewise corresponds to that for the homogeneous operation. The same applies for rotational position wdkhom of throttle valve 12.

What is claimed is:

1. A method for operating an internal combustion engine, comprising:

injecting fuel into a combustion chamber in a first mode during a compression phase;

injecting the fuel into the combustion chamber in a second mode during an intake phase;

controlling a quantity of the fuel injected into the combustion chamber differently for each of the first mode and the second mode;

switching from the first mode initially to a transitional operation of the second mode;

switching from the transitional operation of the second mode to a normal operation of the second mode; and determining a quantity of air supplied, wherein the switching from the first mode to the transitional operation of the second mode is performed as a function of the air quantity supplied, wherein the switching from the first mode to the transitional operation of the second mode is performed after the air quantity supplied is below a first threshold value.

2. The method according to claim 1, wherein the internal combustion engine is in a motor vehicle.

3. The method according to claim 1, further comprising:

determining a quantity of air supplied, wherein the switching from the transitional operation of the second mode to the normal operation of the second mode is performed as a function of the air quantity supplied.

4. The method according to claim 3, wherein the switching from the transitional operation of the second mode to the normal operation of the second mode is performed after the air quantity supplied is below a second threshold value.

5. The method according to claim 1, further comprising:

during the transitional operation of the second mode, controlling a fuel/air mixture to a lean value.

6. The method according to claim 5, further comprising:

after switching from the first mode to the transitional operation of the second mode, determining a fuel quantity to be injected as a function of an air quantity supplied and a torque requested.

7. The method according to claim 5, further comprising:

after switching from the first mode to the transitional operation of the second mode, determining an ignition angle as a function of an air quantity supplied, a fuel quantity injected, and a torque requested.

8. The method according to claim 1, wherein during the normal operation of the second mode, a fuel/air mixture supplied is controlled in accordance with a preselected stoichiometric value.

9. The method according to claim 8, further comprising:

after switching from the transitional operation of the second mode to the normal operation of the second mode, determining a fuel quantity to be injected as a function of an air quantity supplied.

10. The method according to claim 8, further comprising:

after switching from the transitional operation of the second mode to the normal operation of the second mode, determining an ignition angle as a function of a torque requested.

11. A control element for a control unit of an internal combustion engine, the control element storing a program that is executable by a computing device, the computing device causing the internal combustion engine to perform a method of operation, the method of operation comprising:

injecting fuel into a combustion chamber in a first mode during a compression phase;

injecting the fuel into the combustion chamber in a second mode during an intake phase;

controlling a quantity of the fuel injected into the combustion chamber differently for each of the first mode and the second mode;

switching from the first mode initially to a transitional operation of the second mode;

switching from the transitional operation of the second mode to a normal operation of the second mode; and determining a quantity of air supplied, wherein the switching from the first mode to the transitional operation of the second mode is performed as a function of the air quantity supplied, wherein the switching from the first mode to the transitional operation of the second mode is performed after the air quantity supplied is below a first threshold value.

12. The control element according to claim 11, wherein the control element is a read-only memory.

13. The control element according to claim 11, wherein the internal combustion engine is an internal combustion engine of a motor vehicle.

14. An internal combustion engine for a motor vehicle, comprising:

an injection valve injecting fuel directly into a combustion chamber during a compression phase in a first mode and duriOng an intake phase during a second mode; and a control unit controlling a quantity of fuel injected into the combustion chamber, the control unit controlling the quantity differently for each of the first mode and the second mode, the control unit controlling the internal combustion engine to switch from the first mode initially to a transitional operation of the second mode, the control unit controlling the internal combustion engine to switch from the transitional operation of the second mode to a normal operation of the second mode and determining a quantity of air supplied, wherein the switching from the first mode to the transitional operation of the second mode is performed as a function of the air quantity supplied, wherein the switching from the first mode to the transitional operation of the second mode is performed after the air quantity supplied is below a first threshold value.

15. A method for operating an internal combustion engine, comprising:

injecting fuel into a combustion chamber in a first mode during a compression phase;

injecting the fuel into the combustion chamber in a second mode during an intake phase;

controlling a quantity of the fuel injected into the combustion chamber differently for each of the first mode and the second mode;

switching from the first mode initially to a transitional operation of the second mode;

switching from the transitional operation of the second mode to a normal operation of the second mode; and determining a quantity of air supplied, wherein the switching from the first mode to the transitional operation of the second mode is performed as a function of the air quantity supplied.

16. The method of claim 15, wherein the switching from the first mode to the transitional operation of the second mode is performed after the air quantity supplied is below a first threshold value.

17. The method according to claim 15, further comprising:

determining a quantity of air supplied, wherein the switching from the transitional operation of the second mode to the normal operation of the second mode is performed as a function of the air quantity supplied.

18. The method according to claim 17, wherein the switching from the transitional operation of the second mode to the normal operation of the second mode is performed after the air quantity supplied is below a second threshold value.

19. The method according to claim 15, further comprising:

during the transitional operation of the second mode, controlling a fuel/air mixture to a lean value.

20. The method according to claim 19, further comprising:

after switching from the first mode to the transitional operation of the second mode, determining a fuel quantity to be injected as a function of an air quantity supplied and a torque requested.

21. The method according to claim 19, further comprising:

after switching from the first mode to the transitional operation of the second mode, determining an ignition angle as a function of an air quantity supplied, a fuel quantity injected, and a torque requested.

22. The method according to claim 15, wherein during the normal operation of the second mode, a fuel/air mixture supplied is controlled in accordance with a preselected stoichiometric value.

23. The method according to claim 22, further comprising:

after switching from the transitional operation of the second mode to the normal operation of the second mode, determining a fuel quantity to be injected as a function of an air quantity supplied.

24. The method according to claim 22, further comprising:

after switching from the transitional operation of the second mode to the normal operation of the second mode, determining an ignition angle as a function of a torque requested.

25. A control element for a control unit of an internal combustion engine, the control element storing a program that is executable by a computing device, the computing device causing the internal combustion engine to perform a method of operation, the method of operation comprising:

injecting fuel into a combustion chamber in a first mode during a compression phase;

injecting the fuel into the combustion chamber in a second mode during an intake phase;

controlling a quantity of the fuel injected into the combustion chamber differently for each of the first mode and the second mode;

switching from the first mode initially to a transitional operation of the second mode;

switching from the transitional operation of the second mode to a normal operation of the second mode; and determining a quantity of air supplied, wherein the switching from the first mode to the transitional operation of the second mode is performed as a function of the air quantity supplied.

26. The control element according to claim 25, wherein the control element is a read-only memory.

27. The control element according to claim 25, wherein the internal combustion engine is an internal combustion engine of a motor vehicle.

28. An internal combustion engine for a motor vehicle, comprising:

an injection valve injecting fuel directly into a combustion chamber during a compression phase in a first mode and during an intake phase during a second mode; and a control unit controlling a quantity of fuel injected into the combustion chamber, the control unit controlling the quantity differently for each of the first mode and the second mode, the control unit controlling the internal combustion engine to switch from the first mode initially to a transitional operation of the second mode, the control unit controlling the internal combustion engine to switch from the transitional operation of the second mode to a normal operation of the second mode and determining a quantity of air supplied, wherein the switching from the first mode to the transitional operation of the second mode is performed as a function of the air quantity supplied.

* * * * *

UNITED STATES PATENT AND TRADEMARK OFFICE

CERTIFICATE OF CORRECTION

PATENT NO. : 6,792,913 B1
DATED : September 21, 2004
INVENTOR(S) : Michael Oder

It is certified that error appears in the above-identified patent and that said Letters Patent is hereby corrected as shown below:

Title page,
Item [57], ABSTRACT,
Line 1, change "engine (1)," to -- engine, --.
Lines 2-3, change "injection valve (8)," to -- injection valve, --.
Line 4, delete "(4)".
Line 6, delete "(16)".
Line 8, change "chamber (4)," to -- chamber, --.
Line 10, delete "(26)".
Line 11, delete "(31, 37)".
Line 12, change "control unit (16)." to -- control unit. --.

Column 1,
Line 47, change "can not be handled" to -- cannot be handled --.

Column 2,
Line 18, insert -- SUMMARY --; change "A summary objective" to -- An objective --.
Line 47, change "an example embodiments" to -- an example embodiment --.
Line 59, change "can, be measured," to -- can be measured --.

Column 3,
Line 47, change "it is may be advantages;" to -- it may be advantageous --.

Column 4,
Line 7, change "irrespective their antecedent reference." to -- irrespective of their antecedent reference, --.

UNITED STATES PATENT AND TRADEMARK OFFICE

CERTIFICATE OF CORRECTION

PATENT NO. : 6,792,913 B1
DATED : September 21, 2004
INVENTOR(S) : Michael Oder

It is certified that error appears in the above-identified patent and that said Letters Patent is hereby corrected as shown below:

Column 5,
Line 26, change "in connection with of FIGS." to -- in connection with FIGS. --.

Column 8,
Line 57, change "and duriOng an intake phase" to -- and during an intake phase --.

Signed and Sealed this

Fourteenth Day of March, 2006

JON W. DUDAS
*Director of the United States Patent and Trademark Office*